United States Patent [19]

Queneau et al.

[11] 4,044,096

[45] Aug. 23, 1977

[54] SULFURIC ACID LEACHING OF NICKELIFEROUS LATERITE

[75] Inventors: Paul B. Queneau, Golden; Eddie C. Chou, Arvada, both of Colo.

[73] Assignee: AMAX Inc., New York, N.Y.

[21] Appl. No.: 639,712

[22] Filed: Dec. 11, 1975

[51] Int. Cl.[2] ..... C01G 53/10

[52] U.S. Cl. ..... 423/150; 423/124; 423/142

[58] Field of Search ..... 423/150, 140, 141, 142, 423/123, 124; 75/119, 115

[56] References Cited

U.S. PATENT DOCUMENTS

| | | | |
|---|---|---|---|
| 2,842,436 | 7/1958 | Dasher et al. | 423/140 |
| 3,761,566 | 9/1973 | Michal | 423/150 |

OTHER PUBLICATIONS

Queneau, Editor, Extractive Metallurgy of Copper, Nickel, Cobalt Interscience, New York, (1961), pp. 363–397.

Boldt et al., *The Winning of Nickel,* Longmans Canada Ltd., (1967), pp. 290–294, 388, 437–444.

*Primary Examiner*—O. R. Vertiz
*Assistant Examiner*—Brian E. Hearn
*Attorney, Agent, or Firm*—Kasper T. Serijan; Eugene J. Kalil

[57] ABSTRACT

The leaching efficiency of nickeliferous lateritic ore is optimized by scalping the ore to remove a coarse low-nickel fraction and provide a fine nickel-rich fraction which is then high pressure leached in a sulfuric acid solution by controlling the parameters temperature, pulp density, the rate of acid addition, leaching time, agitation rate, etc., whereby a pregnant solution is obtained with the nickel to (Fe+Al+Cr) ratio exceeding about 2.

11 Claims, 4 Drawing Figures

SULFURIC ACID LEACHING OF NICKELIFEROUS LATERITE

This invention relates to the recovery of nickel from nickeliferous lateritic ores and, in particular, to a method of optimizing the leaching of said ores.

STATE OF THE PRIOR ART

It is known to recover nickel and cobalt from lateritic ores. One method is to pulp the nickel ore (95% passing 325 mesh) to approximately 40% solids and leach nickel and cobalt selectively with sulfuric acid at elevated temperature and pressure (e.g. 475° F [247° C] and 525 psig) to solubilize about 90% each of the nickel and cobalt.

The leached pulp is cooled and then washed by countercurrent decantation, with the washed pulp going to tailings. The acid pH which is quite low is then neutralized with coral mud to a pH of about 2.5 to 2.8 and the thus-treated product liquor (containing generally about 4 to 6 grams of nickel per liter) is then subjected to sulfide precipitation by preheating the leach liquor and carrying out the precipitation with $H_2S$ in an autoclave at about 250° F (122° C) and a pressure of about 150 psig. Usually, nickel sulfide seed is added at the feed end to assure substantially complete precipitation of the nickel and cobalt.

After the sulfide precipitate has been washed and thickened to about 65% solids, it is oxidized in an autoclave at about 350° F and a pressure of about 700 psig. The solution of solubilized nickel and cobalt is neutralized with ammonia to a pH (5.35) sufficient to precipitate any iron, aluminum and chromium present using air as an oxidant, the precipitate being thereafter separated from the solution. The nickel and cobalt solution is thereafter adjusted in pH to about 1.5 and $H_2S$ added to selectively precipitate any copper, lead and zinc present, which precipitate is separated from the solution by filtration. The nickel is then selectively recovered from the solution by various methods, one particular method comprising treating the solution in an autoclave with hydrogen at a pressure of about 650 psig at a temperature of about 375° F (192° C), using nickel powder as seed material.

Pregnant liquor generated in the Moa Bay-type leaching of nickel laterite may contain about 40 gpl (grams per liter) of free sulfuric acid, 2 gpl of aluminum and 1 gpl iron. A typical Moa Bay-type leach is one in which the ore is leached at 250° C at an acid ($H_2SO_4$) to ore ratio of about 0.24 to 1 and a pulp density of 33%, pulp densities of up to 45% having been used. Many of the refining processes available for the recovery of nickel from the foregoing solution operate most effectively at lower concentrations of acid, iron and aluminum. A typical Moa Bay ore is one containing 1.35% nickel, 0.14% Co, 0.9% Mn, 0.02% Cu, 0.04% Zn, 47% Fe, 10% $Al_2O_3$, 1% MgO and 39.5% of other constituents and water of hydration.

Variations in the foregoing method have been proposed in order to improve the efficiency thereof. Thus, in U.S. Pat. No. 2,798,804, a method is proposed for reducing ore preparation cost by heating the slurry to 160° F to 180° F (71° C to 77° C) prior to preliminary thickening. In U.S. Pat. No. 2,805,939, it is proposed that a large excess of sulfuric acid be used during leaching followed by hydrolyzing the iron out by dilution of the hot pregnant liquor.

In U.S. Pat. No. 3,082,080, manganese dioxide is added to the ore to promote the dissolution of chromium by oxidizing $Cr^{+3}$ to $Cr^{+6}$.

In none of the foregoing methods is there any recognition of achieving the full economic impact of the overall leaching process by controlling in combination the ore sizing, temperature, percent solids in the pulp, acid/ore ratio, acid addition rate, leaching time, agitation of the leach mix and the oxygen content.

We have unexpectedly found following considerable in-depth study of the key process variables associated with the unit process that high quality pregnant liquor can be obtained at improved efficiency at a relatively high nickel to impurity ratio.

OBJECTS OF THE INVENTION

It is thus an object of the invention to provide a process for optimizing the pressure leaching of nickeliferous lateritic ores.

Another object of the invention resides in controlling a novel combination of operational steps to improve the economics and efficiency of leaching of nickeliferous lateritic ores.

These and other objects will more clearly appear when taken in conjunction with the following disclosure and the accompanying drawing, wherein.

STATEMENT OF THE INVENTION

Figure 1:
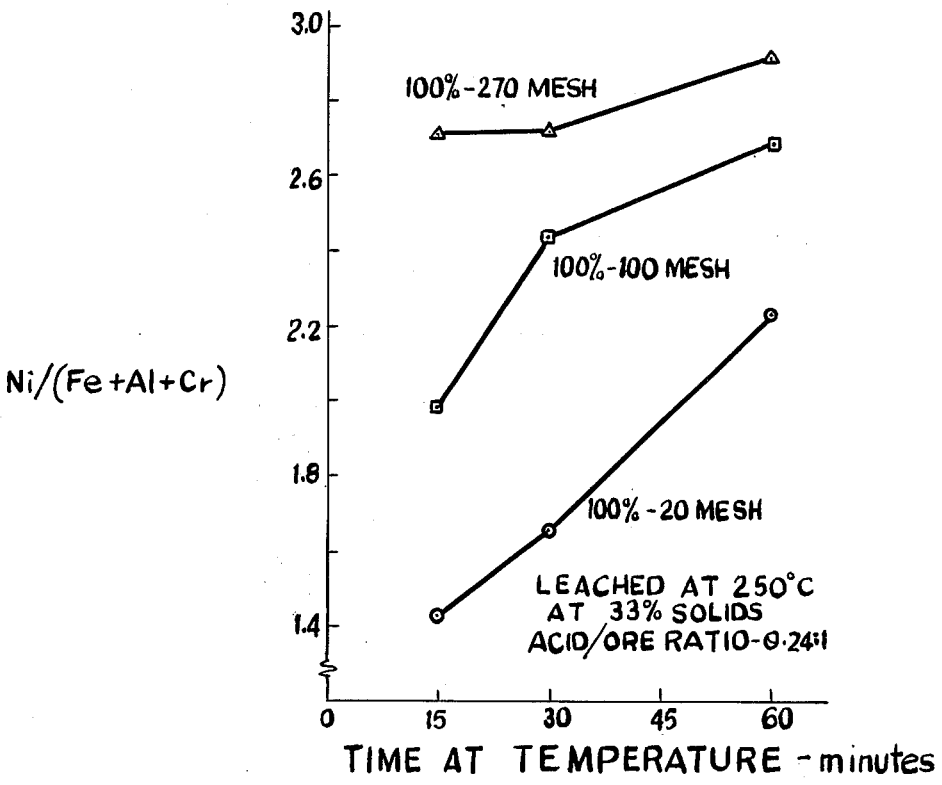
FIG. 1 is a set of curves showing the relationship between the Ni/(Fe+Al+Cr) ratio and the particle size of the laterite ore being leached.

One embodiment of the invention resides in optimizing the leaching efficiency of nickeliferous lateritic ore in which the ore is scalped to remove a coarse low-nickel fraction and provide a remaining fine nickel-rich fraction.

In determining the size cut-off between the coarse low-nickel fraction and the fines nickel-rich fraction, a unit weight of the lateritic ore of generally minus 2 or 3 mesh is selected and the particle size distribution thereof determined along with the nickel assay for each particle size fraction. In addition to screen sizes No. 2 and/or No. 3, the Tyler screen sizes employed include No. 4, No. 6, No. 8, No. 10, No. 14, No. 20, No. 28, No. 35, No. 48, No. 65, No. 100, No. 150, No. 200, No. 270 and minus 400 mesh.

Having made the particle size determination and the nickel assays of each size fraction, a cut-off is made between the sum of the coarse fractions in which the combined average nickel content is less than 0.7% by weight and the total fines fractions in which the combined average nickel content is at least about 1% by weight, the amount of the nickel in the separated fines fraction constituting at least about 70% by weight, generally at least about 80%, of the total nickel in the ore sample. The nickel-rich fines fraction utimately obtained may be comminuted, if necessary, depending upon the particle size of the fines fraction.

The fines fraction is then subjected to a series of operational steps comprising forming an aqueous slurry of said fraction at a pulp density not exceeding about 33% solids (e.g. not exceeding 30% such as 10% to 25% solids), injecting into said slurry all of the required sulfuric acid in a single addition at an acid to ore ratio of about 0.2 to 0.35, and then subjecting said pulp or slurry to high pressure leaching at a temperature of over about 260° C and ranging up to about 290° C, e.g. 270° C to 290° C at a pressure of about 700 psig to 1000 psig at an oxygen overpressure of at least about 50 psig for a time of at least about 30 minutes where required to oxidize ferrous iron to ferric iron. In carrying out the invention, the leach pulp is subjected to an agitation rate sufficient to maintain a solids suspension, thereby leaching the nickel from the ore at a dissolution efficiency of at least about 95% at a nickel to Fe+Al+Cr ratio exceeding about two.

A typical lateritic ore composition ranges by weight from about 0.5% to 2.5% Ni, 0.005% to 1% Co, 0.2% to 10% Al, 0.3% to 15% Cr, up to 15% Mg, 0.25% to 5% Mn, 2% to 45% $SiO_2$ and the balance substantially 10% to 55% Fe, the foregoing metal values being present as oxides.

DETAILS OF THE INVENTION

ORE PREPARATION

Generally, the comminuted ore is easily separable into a coarse and a fine fraction. For the purposes of this invention, the ore is scalped to remove a coarse fraction of +100 mesh which is usually low in nickel. For example, for a particular lateritic ore containing about 1.6% nickel, the +100 mesh coarse fraction has been determined to contain about 0.46% Ni and the −100 mesh fraction to contain 1.7% Ni. In the event the ore contains substantial amounts of magnesium, the coarse fraction will contain a large portion of the magnesium in the ore. The coarse fraction can be saved for neutralization of the autoclave discharge slurry. By removing as much magnesium as possible from the leaching circuit, savings in acid consumption are effected.

The −100 mesh fraction remaining may then be leached; however, it is preferably ground to pass 270 mesh. This results in a substantial increase in the nickel to impurity ratio in the pregnant liquor. This is illustrated in FIG. 1 which shows the −100 and −270 mesh size to be superior to the −20 mesh fraction, the −270 mesh size being particularly preferred, the ratio Ni/(Fe+Al+Cr) being in excess of 2.6:1, the ratio increasing with leaching retention time. Although the nickel/impurity ratio data were obtained at 250° C, the trend is the same at the preferred high temperature of over 260° C, e.g. 270° C to 290° C.

Once the nickel content of the various ore fractions has been obtained, the cut-off between the low-nickel fraction and the nickel-rich fraction is easily obtained by using separation techniques well known to those skilled in the art.

Thus, in a particular lateritic ore, a trommel oversize of about 2.3% of the total weight and constituting plus 3 mesh in size was separated from the ore, the oversize containing 0.7% of the total nickel. This left a classifier feed constituting 97.7% of the total weight of the ore and which contained 99.3% of the total nickel content of the ore, the nickel content of the feed being about 1.6% by weight.

The classifier feed is classifed by using a rake-type or screw-type Dorr-Oliver classifier to provide classifier sands constituting 22.5% by weight of the initial ore, of which 85% of the sand was plus 270 mesh and assayed 0.6% nickel by weight, the nickel content of the sands making up 8.9% of the total nickel in the ore; and to provide a classifier overflow constituting 75.2% of the total weight of the ore and assaying 1.83% nickel, the overflow being about 85% minus 270 mesh and containing 90.4% of the total nickel in the ore.

In this instance, the plus 270 mesh classifier sands would be the coarse low-nickel fraction (0.6% nickel) and the classifier overflow the nickel-rich fines fraction (1.83% nickel).

When these two fractions were leached for 60 minutes using an acid to ore ratio of 0.24:1 by weight, the classifier sands consumed 50 lbs. of sulfuric acid per lb. of nickel dissolved at 80% nickel extraction efficiency; whereas, the classifier overflow consumed only 14 lbs. of sulfuric acid per pound of nickel dissolved at 95% nickel extraction efficiency. Moreover, the ratio of nickel to Fe+Al in solution was substantially over 2 for the leached classifier overflow as compared to substantially less than 1 for the leached classifier sands.

The foregoing points up the importance of size classification.

In classifying the particulate ore into the predetermined coarse and fine fractions, screening is preferred; however, another preferred method is to use classifiers, such as the rake type or screw type classifiers mentioned hereinabove. The use of screens and classifiers to effect separation between relatively coarse and relatively fine material is disclosed in Chapter V, pages 118 to 160, Vol. 1, of the *Handbook of Non-Ferrous Metallurgy* by Donald M. Liddell (McGraw-Hill Book Company, Inc., New York, N.Y. 1926).

ORE PULP DENSITY

According to the literature, emphasis is placed on the desirability of thickening the ore feed to a pulp density of 45% solids. Such pulp densities have been described when operating in a leaching temperature range of 240° C to 260° C, the temperature generally employed being about 250° C.

It has been found, contrary to the foregoing, that improved leach efficiency can be obtained by leaching at a lower pulp density, for example, at a pulp density not exceeding 33% and preferably 20% to 30%, provided that the leaching temperature is in excess of 260° C and ranging up to 290° C, a temperature of 275° C being preferred. It is preferred that the pulp be preheated to 65° C to 90° C.

A comparison of leaching at 250° C and 275° C is shown in Tables 1 and 2 below. It will be noted that as the pulp density is decreased to 25%, a further improvement of leaching efficiency of the ore obtains at 275° C as compared to a relatively low pulp density of 33%. The leaching was carried out at a pressure of 860 psig. The oxygen overpressure was not required because natural weathering of the particular ore tested had already oxidized most of the iron present to the ferric state.

Table 1

| % Solids | Acid/Ore | Pregnant Liquor Ni/Fe | Pregnant Liquor Ni/Al | % Ni Extn. | Temp. |
|---|---|---|---|---|---|
| 25 | 0.21 | 16 | 6 | 91 | 250° C |
| 33 | 0.21 | 14 | 8 | 93 | 250° C |
| 25 | 0.24 | 13 | 4 | 95 | 250° C |
| 33 | 0.24 | 14 | 6 | 95 | 250° C |

Table 2

| % Solids | Acid/Ore | Pregnant Liquor Ni/Fe | Pregnant Liquor Ni/Al | % Ni Extn. | Temp. |
|---|---|---|---|---|---|
| 25 | 0.21 | 23 | 12 | 94 | 275° C |
| 33 | 0.21 | 16 | 12 | 93 | 275° C |
| 25 | 0.24 | 18 | 8 | 97 | 275° C |
| 33 | 0.24 | 9 | 5 | 95 | 275° C |

Figure 2:
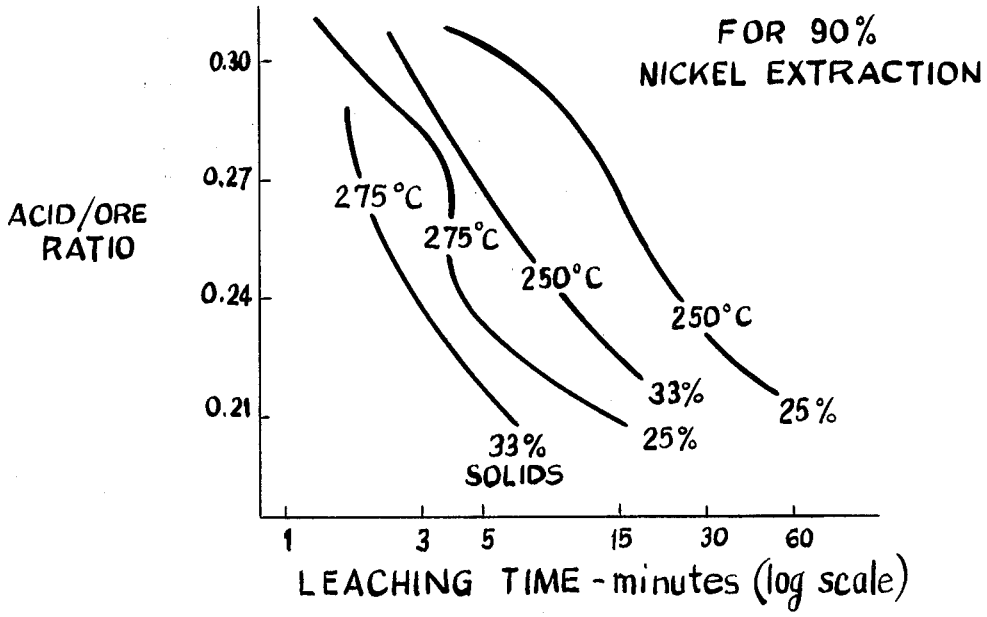
FIG. 2 depicts curves comparing 275° C leaching to 250° C leaching at pulp densities of 25% and 33%.

The foregoing comparison is even more apparent from FIG. 2 which compares the 250° C leach with the 275° C leach for 25% and 33% pulp density at an acid to ore ratio (weight of $H_2SO_4$ to dry weight of ore) ranging from about 0.21 to 0.30.

Microscopic examination of the laterite ore showed the principal mineral goethite to have fiber-like crystals. During feed preparation, these crystals tend to become tangled and produce a high viscosity slurry which is difficult to pulp. This effect is particularly noticeable above 33% solids which makes operation in the high solids range very difficult. An advantage of combining low pulp density (e.g. 25%) with high temperature (e.g. 275° C) is that less acid is required to attain a given level of nickel extraction than does the high solids (e.g. 45%) — low temperature (e.g. 250° C) combination.

This will be apparent from Table 3 below which reports leaching data on laterite ore assaying 1.72% Ni, 0.14% CO, 41% Fe, 2.5% Al, 1.58% Mg, 0.8% Mn, 2.05% Cr, 12.1% $SiO_2$ and 11.3% LOI (Loss on Ignition*), the elemental metals being combined with oxygen.

Table 3

| Temperature % | % Solids | Acid/Ore | % Ni Extraction |
|---|---|---|---|
| 250 | 25 | 0.21 | 91 |
| 275 | 25 | 0.21 | 94 |
| 250 | 25 | 0.24 | 95 |
| 275 | 25 | 0.24 | 97 |
| 250 | 33 | 0.21 | 93 |
| 275 | 33 | 0.21 | 93 |
| 250 | 33 | 0.24 | 95 |
| 275 | 33 | 0.24 | 95 |

*Weight loss of sample obtained during the thermal treatment of the sample in air at 1100° C.

The effect of acid savings on process economics is discussed in the literature with regard to the Moa Bay Cuban plant. It has been reported that sulfuric acid constitutes around 24% of the production cost and that reducing the specific consumption of sulfuric acid by one percentage point can represent a saving of 18,000 tons of sulfuric acid per year.

ACID ADDITION

Figure 3:
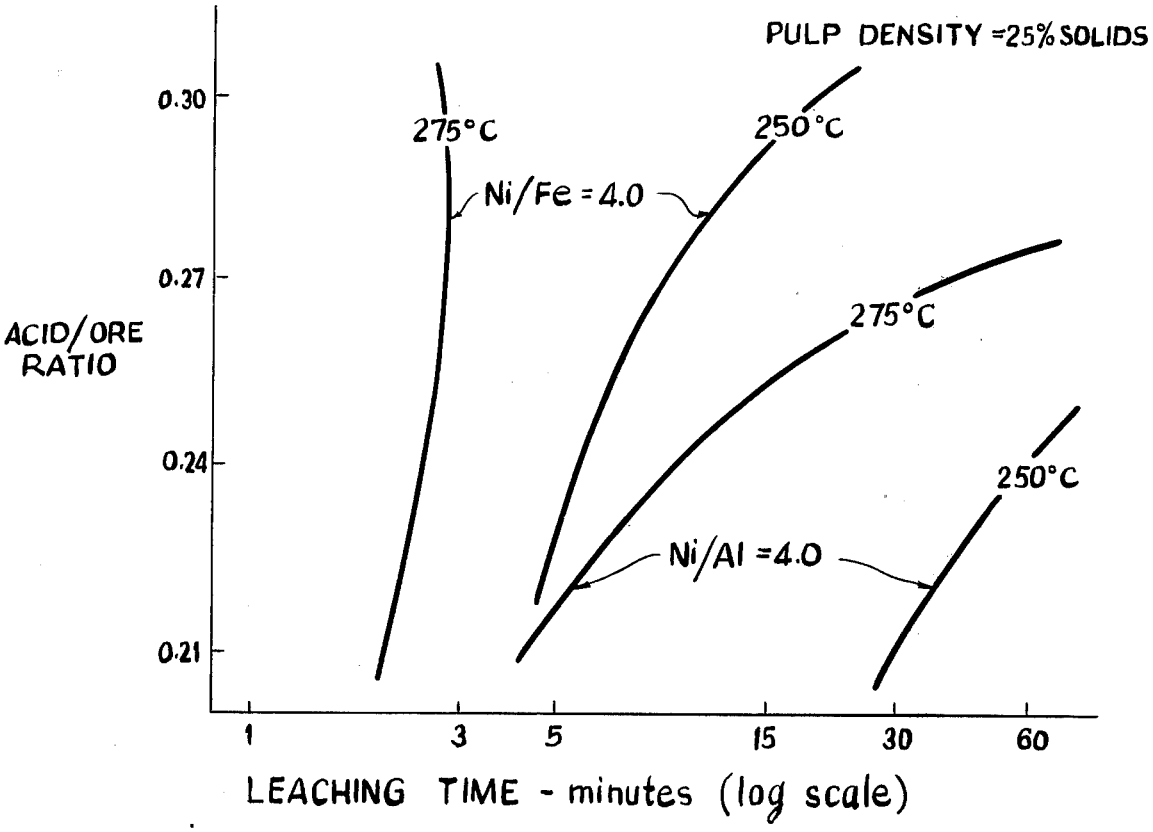
FIG. 3 shows curves relating acid to ore ratio as a function of leaching time, temperature and metal to impurity ratio at 25% solids in the pregnant liquor.

We have found that the manner in which the sulfuric acid is added to the pulp is additionally important in assuring optimum extraction of nickel. For example, we have noted that an all-at-once addition of sulfuric acid in the first of a train of autoclaves gives a much better extraction of nickel than the addition of acid in stages. In a first test run involving a pulp of the foregoing ore assay at 33% solids and an acid-to-ore ratio of 0.24:1, the all-at-once addition of sulfuric acid in a few seconds in the autoclave at 250° C under a total pressure of 580 psig (no oxygen partial pressure) resulted in an extraction of 96% nickel following a one hour leach; whereas, in a second test run in which the same quantity of acid was pumped into the autoclave uniformly over the first half hour of the leach period with the leach continued for an additional hour, only 88% of the nickel was extracted. Additional tests have shown that by increasing the operating leaching temperature and reducing the pulp density, there is a dramatic increase in the rate of nickel extraction. For example, increasing the leaching temperature to 275° C at 25% solids and an acid-to-ore ratio of 0.24, decreases the time to attain over 90% nickel extraction and the time needed for aluminum hydrolysis by a factor of six. This will be apparent from FIG. 3 which illustrates the marked decrease in leaching time in going from 250° C to 275° C at said acid-to-ore ratio.

Thus, summarizing the foregoing, it is important that the solids content of the pulp be maintained not to exceed 33%, and preferably be below 33%, and the leaching temperature above 260° C and range up to about 290° C, e.g. 265° C to 290° C, such as 275° C. The higher the temperature, the greater is the benefit of leaching at low percent solids. For example, at a leach temperature of 280° C, it would be preferred to employ a solids content of about 20%. It has been observed that at high leaching temperature, a higher sulfur form of alunite obtains which is quite stable ($Al_2O_3.2SO_3.1H_2O$ rather than $3Al_2O_3.4SO_3.9H_2O$). Apparently, high solids promote formation of the more stable compound, especially at the high temperature due to associated high $H_2SO_4$ content of the leach liquor. Thus, high sulfur alunite results in a waste of acid and hence lower nickel extraction.

The effect of temperature on leaching time, extraction efficiency, nickel-to-impurity ratio at 26% solids content in the autoclave is shown in Table 4 below.

Table 4

| Temp. ° C | Leaching Time Minutes | Acid/Ore Ratio | Filtrate Ni/Al | Filtrate Ni/Fe | % Ni Extraction |
|---|---|---|---|---|---|
| 250° C | 72 | 0.22 | 1.0 | 2.6 | 95 |
| 270° C | 52 | 0.20 | 2.0 | 4.6 | 97 |

As will be noted, the high temperature-low acid technique of leaching not only increased nickel recovery by 2%, but also decreased the aluminum and iron content of the pregnant liquor by approximately a factor of two. Additionally, the leach time was decreased approximately 25%.

In order to maximize contact of fresh acid with fresh incoming ore, it is preferred that the leach train design (a series-connected group of autoclaves) incorporate an acid injection system in which, for example, the acid contacts turbulently flowing preheat fresh ore pulp or slurry in a pipe or a small mixing pot prior to just flowing into the first autoclave of the leach train. In this way, there would be minimum opportunity for leach particles to recontact fresh concentrated acid.

MIXING OF THE PULP DURING LEACHING

It is known that mixing or stirring the pulp-acid composition inhibits scaling due to iron and aluminum hydrolysis products within the autoclave (particularly the first autoclave). High speed agitators prevent crust from forming on the internal parts of the autoclave. We have found that high speed agitation combined with the other process parameters herein is desirable in the first autoclave in achieving consistently high nickel recovery with minimum all-at-once acid additions, However, we have also found that the additional autoclaves downstream of the first autoclave do not require the use of high speed agitators just so long as the mixing is sufficient to keep the solids in suspension. We have found that additional agitation downstream of the first autoclave not only does not give more rapid nickel extraction, but also hinders the subsequent thickening operation. Thus, by minimizing agitation downstream of the autoclave, better thickening response is assured together with decreased power costs.

Comparison of 600 rpm agitation speed (i.e. strong agitation, e.g. greater than 10 horsepower per 100 gallons of bulk) with 50 rpm agitation (i.e. low agitation, e.g. less than 3 horsepower per 1000 gallons) in the first autoclave at the point of all-at-once acid addition showed that the higher speed gave excellent all around leaching results from the viewpoint of no crust formation, optimum nickel extraction and minimum amount of acid required to leach the ore. It is thus preferred that, when two or more autoclaves are employed in a leach train, high speed stirring is used only in the first autoclave, the agitation in the remaining autoclave being minimal and at least sufficient to maintain the ore in suspension.

OXYGEN IN THE LEACH SLURRY

If organic material, such as a hydrocarbon flocculant or vegetable matter, becomes mixed with laterite feed, poor leach response may result. Normally, iron in the ferric state is insoluble. However, such hydrocarbons can reduce ferric iron during pressure leaching to the soluble ferrous iron. In a test conducted at a total pressure of 960 psig and an oxygen partial pressure of 100 psig in an autoclave at 275° C, at a pulp density of 33% solids, and at an acid-to-ore ratio of 0.25:1 on the ore assay given hereinbefore with and without 12.5 lbs./ton ore of Orzan (trademark for a flotation reagent containing 42% carbon), the results showed that oxygen is necessary when the ore contains such hydrocarbons. When Orzan was not present in the ore and oxygen was not used, the resulting pregnant liquor contained 9 gpl Ni, 1.5 gpl Fe and 2 gpl Al. When oxygen was used and Orzan was not present, the pregnant solution assayed 10 gpl Ni, 0.74 gpl Fe and 2.2 gpl Al.

On the other hand, when no oxygen was used during leaching and the ore contained 12.5 lbs./ton of Orzan, the pregnant solution assayed 7.3 gpl Ni, 13.6 gpl Fe and 1.2 gpl Al. As will be noted, the leach liquor contained high iron. However, when oxygen was employed during the leach (100 psig), the amount of iron in the pregnant liquor dropped dramatically as evidenced by the following assay: 9 gpl Ni, 1.2 gpl Fe and 2.9 gpl Al.

It is known to add oxidants to laterite feed to alter leach response. For example, in U.S. Pat. No. 3,082,080, the addition of $MnO_2$ is disclosed for maximizing the dissolution of chromium in the ore.

IRON AND ALUMINUM PRECIPITATION

The iron and aluminum which precipitates during leaching tends to redissolve during countercurrent decantation unless a neutralizer is added (preferably to the leach flash tank) to bring the pulp up to a pH of 2. Most laterite ore bodies contain some serpentine, some of which appears in the coarse fraction screened or scalped during ore preparation.

Comparisons were made on autoclave discharge with and without a neutralizer. For example, in a first test, an autoclave discharge was maintained at residence times of 0, 1, 2, 4, 8 and 20 hours at 85° C following pressure leaching in which the iron content of the pregnant liquor increased from 1.48 at zero hour to 3.6 gpl Fe at 20 hours, the aluminum content increasing from 2.8 gpl to 3.4 gpl. In a second test, the autoclave discharge was neutralized using serpentine-type material (0.43% Ni, 24.5% Mg, 0.16% Al, 6% Fe) to a pH up to 2 and, after simple agitation, the iron and aluminum content of the neutralized discharge was determined for resistance times of 0, 1, 2, 4, 8 and 20 hours. The iron content decreased from 1.66 gpl at zero retention time to 0.15 gpl at 20 hours, the aluminum decreasing from 3.2 gpl at zero time to 2 gpl at 20 hours.

By partially neutralizing the leach slurry or pulp, the redissolution of iron and aluminum is greatly inhibited. The flash tank is preferred for this operation in that: (1) the extreme turbulence in the tank due to the release of pressure assures good solid/liquid contact prior to countercurrent decantation, and (2) quick neutralization of the pulp immediately after flashdown prevents redissolution of iron that must later be hydrolyzed by the aforementioned neutralization step. The reprecipitation of iron takes more time which is avoided by flash tank addition. A pH of at least 1.8 is required to prevent downstream iron and aluminum leach dissolution. A pH above 4.5 is to be avoided; otherwise, nickel tends to precipitate out.

SULFUR CONTENT OF SOLIDS RESIDUE

The sulfur content of the solids residue should be as low as possible in order to maintain sulfuric acid consumption to a minimum.

Figure 4:
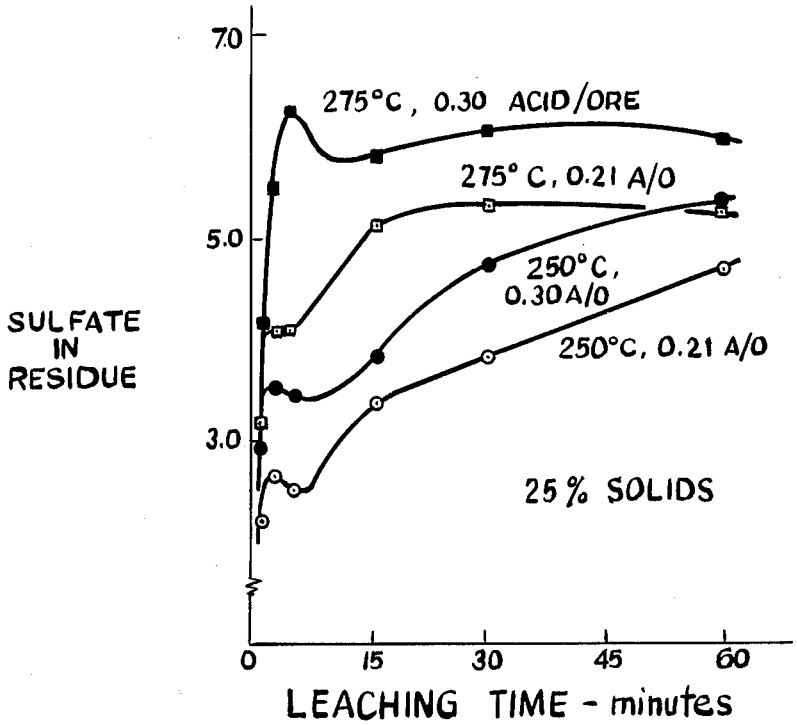
FIG. 4 depicts curves showing sulfate content of the leach residue as a function of time and temperature at a pulp density of 25%.

By using a temperature higher than 260° C in the high pressure leach, it is possible to lower the sulfate content of the residue provided the acid to ore ratio is kept as low as possible. This is shown in FIG. 4 which compares leaching at 275° C and an acid to ore ratio of 0.3 with leaching at 275° C and an acid to ore ratio of 0.21. As will be noted, the lower acid to ore ratio of 0.21 to 1 gave better results.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A process for improving the leaching efficiency of nickeliferous lateritic ore of minus 100 mesh size and containing at least about 1% by weight of nickel which comprises, providing in an autoclave an aqueous slurry of said ore at a pulp density of not exceeding about 33% solids, subjecting said slurry to high pressure leaching in a sulfuric acid solution in said autoclave at a temperature of over 260° C and ranging up to about 290° C at a pressure of about 700 psig to 1000 psig at an agitation rate sufficient to suspend solids in said slurry, the amount of sulfuric acid being injected in said autoclave in a single addition and corresponding to an acid-to-ore ratio ranging from about 0.2 to 0.35, the leaching time being sufficient to leach at least about 95% of said nickel, and then discharging the leached slurry into a flash tank such that the slurry is subjected to turbulence due to the release of autoclave pressure during flashdown, the slurry being then neutralized during said turbulence to a pH of at least about 1.8 but not exceeding about 4.5 to precipitate iron and aluminum and thereby inhibit dissolution of precipitated iron and aluminum downstream of said process and provide a pregnant solution having a nickel to Fe+Al+Cr ratio exceeding 2.

2. The process of claim 1, wherein the ore prior to leaching is comminuted to pass through 270 mesh screen, such that, following leaching, the nickel to Fe+Al+Cr ratio in solution is further increased.

3. The process of claim 1, wherein said leaching is carried out at an oxygen overpressure of at least about 50 psig.

4. The process of claim 1, wherein the pulp density is approximately 25%, the acid to ore ratio approximately 0.2:1 and the temperature approximately 275° C.

5. The process of claim 1, wherein a high agitation rate is employed during high pressure leaching corresponding to a stirring energy of at least about 10 horsepower per 1000 gallons of slurry.

6. A process of improving the leaching efficiency of nickeliferous lateritic ore which comprises, providing said ore in particulate form, determining the particle size distribution of said ore in terms of size fractions including the nickel assay of said fractions, separating the coarse fractions in which the combined average nickel content by weight is less than about 0.7% nickel from fines in which the combined average nickel content by weight of said fines is at least about 1%, said separated fines fraction being less than 100 mesh in size and containing at least about 70% of the total nickel in the ore, providing in an autoclave an aqueous slurry of said nickel-rich fraction at a pulp density of about 20% to 30%, subjecting said slurry to high pressure leaching in a sulfuric acid solution in said autoclave at a temperature of over 260° C and ranging up to about 290° C at a pressure of about 700 psig to 1000 psig at an agitation rate sufficient to suspend solids in said slurry, the amount of acid being injected in said autoclave in a single addition and corresponding by weight to an acid-to-ore ratio of about 0.2:1 to 0.35:1, discharging said leached slurry into a flask tank such that said slurry is subjected to turbulence due to the release of autoclave pressure during flashdown, and neutralizing said leached slurry to a pH of at least about 1.8 but not exceeding about 4.5 to precipitate iron and aluminum while under said state of turbulence and inhibit dissolution of precipitated iron and aluminum downstream of said process, thereby leaching at least about 95% of the nickel and provide a pregnant liquor in which the nickel to (Fe+Al+Cr) ratio exceeds about 2.

7. The process of claim 6, wherein the ore prior to leaching is comminuted to pass through 270 mesh screen, such that, following the leaching, the nickel to Fe+Al+Cr ratio in solution is further increased.

8. The process of claim 6 wherein the acid to ore ratios ranges from about 0.2:1 to 0.25:1.

9. The process of claim 8, wherein the pulp density is approximately 25%, the acid to ore ratio approximately 0.2:1 and the temperature approximately 275° C.

10. The process of claim 6, wherein a high agitation rate is employed during high pressure leaching corresponding to a stirring energy of at least about 10 horsepower per 1000 gallons of slurry.

11. The process of claim 6, wherein said leaching is carried out at an oxygen overpressure of at least about 50 psig.

* * * * *